United States Patent [19]

Saito

[11] 4,051,643

[45] Oct. 4, 1977

[54] METHOD OF PACKING ARTICLES WITH HEAT SHRINKABLE FILMS

[75] Inventor: Akio Saito, Tokorozawa, Japan

[73] Assignee: Showa Seitai Kogyo Kaisha Limited, Japan

[21] Appl. No.: 731,820

[22] Filed: Oct. 12, 1976

[30] Foreign Application Priority Data

Oct. 23, 1975 Japan ..... 50-126912

[51] Int. Cl.[2] ..... B65B 53/02

[52] U.S. Cl. ..... 53/30 S; 53/141; 53/184 S

[58] Field of Search ..... 53/30 S, 141, 184 S

[56] References Cited

U.S. PATENT DOCUMENTS

| | | | |
|---|---|---|---|
| 2,597,041 | 5/1952 | Stokes | 53/141 |
| 3,590,549 | 7/1971 | Zelnick | 53/30 S |

*Primary Examiner*—Travis S. McGehee

*Attorney, Agent, or Firm*—Wenderoth, Lind & Ponack

[57] ABSTRACT

An article is packed with a heat shrinkable film having a width larger than that of the article. The film is moved in contact with a heating member and then immediately wrapped under tension about the article with the opposite side edges of the film protruded beyond the opposite ends of the article. At the same time, the film shrinks about the article to tightly pack it not only on the peripheral surface but also on the end surfaces of the article.

5 Claims, 12 Drawing Figures

METHOD OF PACKING ARTICLES WITH HEAT SHRINKABLE FILMS

BACKGROUND OF THE INVENTION

This invention relates to a method of packing an article by means of a heat shrinkable film.

A polyethylene film which has been elongated in one or two directions has a property of shrinking a predetermined amount when it is heated so that it is used to pack articles of various shapes by utilizing its heat shrinkable property.

For example, this method of packing is applied for packing a large coil of wide paper such as newspaper, and a pallet supporting articles stacked thereon in a plurality of stages or layers.

Such packing is generally performed in the following manner. Thus, a sheet of the heat shrinkable film shaped to cover an article to be packed is placed on the article such as a paper coil or a pallet carrying articles, then the assembly is passed through a heated oven to cause the sheet to shrink and pack the article.

However, this method accompanies the following defects. More particularly, it is necessary to perform the heat shrinkable film into a bag suitable to contain the article to be packed. This requires the step of preparing the bag, so that where it is desired to pack articles of different size and configuration, it is necessary to prepare and stock a variety of bags.

Such packing can also be accomplished by mounting a sheet of the heat shrinkable film on an article to be packed, forming the sheet into a bag surrounding the article and then causing the bag to heat shrink thereby packing the same.

In some cases, the oven for effecting the heat shrink is large requiring a large cost of installation. Such large oven requires a large quantity of heat to initially raise the temperature and to maintain the operating temperature thus increasing the cost of packing.

In an alternative method, a heat shrinkable film is wrapped about an article to be packed under a suitable tension so as to pack the article by the compressive force created by shrinkage. However, this method is difficult to adequately wrap the film and the compressive force is not uniform.

SUMMARY OF THE INVENTION

It is an object of this invention to provide an improved method of packing an article by means of a heat shrinkable film.

As a result of my exhaustive investigation and test, I have found that when a heat shrinkable film is contacted under tension against a heating member, and then immediately wrap the heated film about an article to be packed having a smaller size than the width of the film with both side edges of the film overhanging beyond the opposite ends of the article, the film shrinks to pack the article with the overhanging portions. Consequently, the article is compressed in a direction perpendicularly to the direction of wrapping thus forming a compact packing.

According to one aspect of this invention, there is provided a method of packing an article with a heat shrinkable film comprising the steps of moving the heat shrinkable film, contacting the film against a heating member heated to a predetermined temperature sufficient to cause the film to shrink, and then immediately wrapping under a predetermined pressure the heated film about an article to be packed having a width smaller than that of the heat shrinkable film with the side edges of the film protruded beyond the opposite ends of the article, thus tightly packing the article not only on the peripheral surface but also on the end surface of the article by the heat shrinkable film.

According to another aspect of this invention, there is provided a method of packing an article with heat shrinkable films, each having a width larger than that of the article, comprising the steps of continuously moving the article, continuously advancing a pair of heat shrinkable films toward the article from the opposite sides thereof, contacting the films against a pair of heating rollers movable toward and away from each other and heated to a predetermined temperature sufficient to cause the films to shrink, moving the heated rollers firstly away each other and then toward each other while the article is moved continuously thereby covering the periphery and the end surfaces of the article by the heated films with the side edges thereof protruded beyond the opposite sides of the article and fusing together the pair of heat shrinkable films by said heating rollers while simultaneously causing the films to shrink about the article, and severing the films at the fused portion.

This modified method is especially useful to continuously pack articles of relatively small size while conveying them by means of a conveyor.

The heat shrinkable film utilized for carrying out the method of this invention generally comprises a polyethylene film elongated along two axes, but a polyethylene film elongated along one axis can also be used.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

One embodiment of this invention wherein a roll of newspaper is packed will now be described with reference to FIG. 1.

Figure 1:
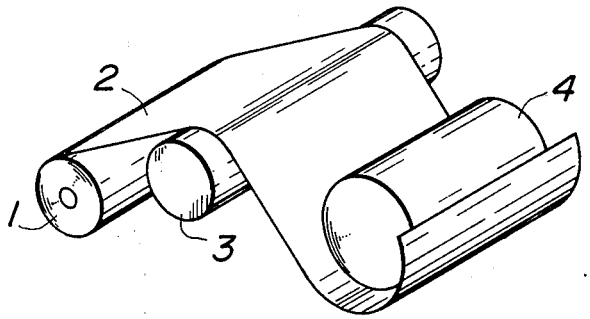
FIG. 1 is a perspective view showing one embodiment of the method of this invention.

In FIG. 1, a heat shrinkable film 2 of the type referred to the above is paid out from a coil 1 and then brought to contact a rod 3 heated to a predetermined temperature. The film thus heated is immediately wrapped about a coil 4 of the newspaper before shrinking. The surface of the heating rod 3 is roughened by sand blasting, for example, to avoid sticking of the film.

Figure 2:
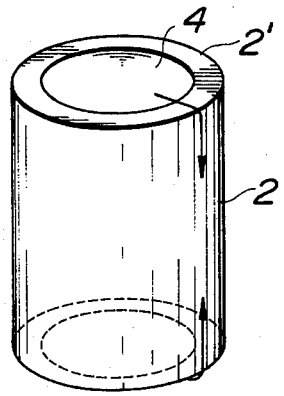
FIG. 2 is a perspective view of an article packed by the method shown in FIG. 1.

In one example, a coil of newspaper having a diameter of 380mm and a width of 200mm was packed. The heat shrinkable film (made of Mitsui Polychemical Co. and sold under the trademark of Mirason M-102) and having a width of 310mm and a thickness of 0.2mm was paid out from a coil and contacted against a heating roll having a diameter of 210mm and a length of 600mm and heated to 160° C. The heated heat shrinkable film was then immediately wrapped about the newspaper coil with each side edge of the film protruded about 55mm beyond each side of the newspaper coil 4. Then, the film tightly shrank about the newspaper coil 4 to pack not only the peripheral surface but also substantial areas of the end surfaces as shown by 2′ in FIG. 2. The film thus shrunk did not contain any wrinkle and created therein a strong clamping force acting in the direction shown by arrows in FIG. 2.

During wrapping, a suitable tension may applied to the shrink-above film by making the pay out speed from the coil 1 to be smaller than the wrapping speed about the newspaper coil 4. For example, where a newspaper roll having a diameter of 400mm and a width of 150mm was rotated at a peripheral speed of 18m/min. the heat shrinkable film was fed at a speed of 9m/min. Then, the film was tightly shrunk about the newspaper roll with annular end shrunk portions 2′ each having a width of 150mm. At this time, the temperature of the rod 3 was 160° C.

The time for raising the temperature of the heating rod 3 to 160° C was several minutes when a heating power of 3KWH was used. This short time should be compared with 40 to 50 minutes required for raising the temperature of a heating oven utilized in the conventional method to the operating temperature.

Figure 3:
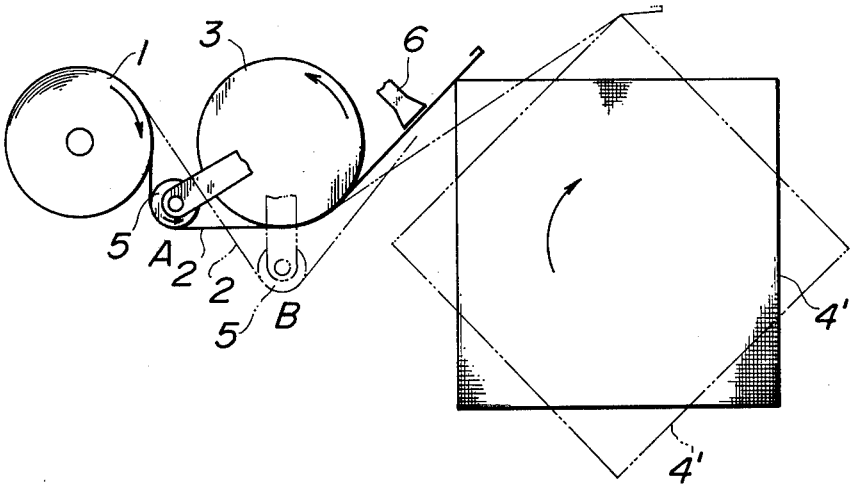
FIG. 3 is a diagrammatic representation showing a modified method of this invention.

FIG. 3 shows another method of wrapping the heat shrinkable film. In this case, the article 4′ to be packed has a square cross-section and is rotated in the direction of an arrow. While a heat shrinkable film 2 paid out from the coil 1 is heated by a heating rod or roller 3 and wrapped about the article 4′, the film is passed about a dancing roller 5 swinging between two positions A and B whereby when the dancing roller 5 occupies the position A the film 2 contacts the periphery of the heating roller 3 wherein at the position B the film 2 disengages from the heating roller. At the commencement of the wrapping of the film 2 the dancing roller 5 is brought to the position A to heat the film 2. A vacuum suction head 6 is provided to attract the film 2 at the end of the wrapping operation for severing the film by a knife, not shown.

By heating the dancing roller 4 to a temperature not causing heat shrinkage of the film 2, for example about 80° C, the film is preheated so that it is heated uniformly by the heating roller thus assuring uniform packing.

Figure 4:
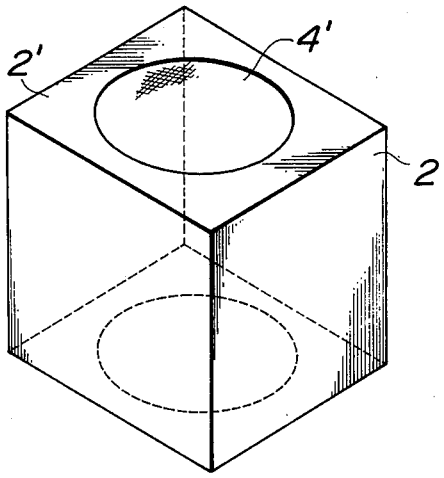
FIG. 4 is a perspective view of an article packed by the modified method shown in FIG. 3.
Figure 5D:
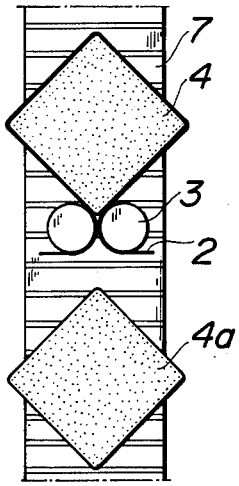
FIGS. 5A to 5D and FIGS. 6A to 6D show modified methods of this invention suitable for continuously packing relatively small articles having square or rectangular shape.
Figure 5C:
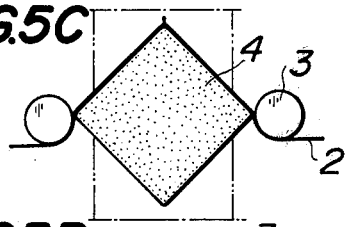
Figure 5B:
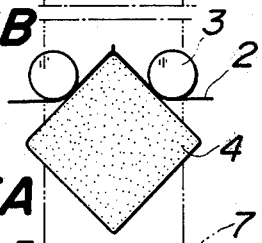
Figure 5A:
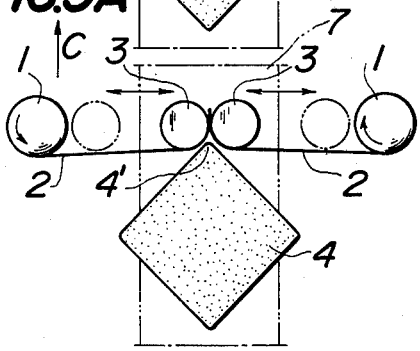
Figure 6D:
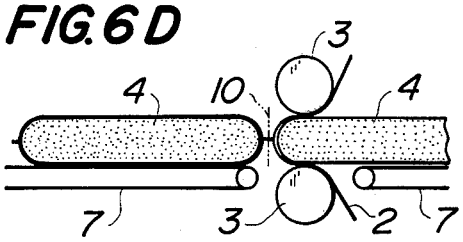
Figure 6C:
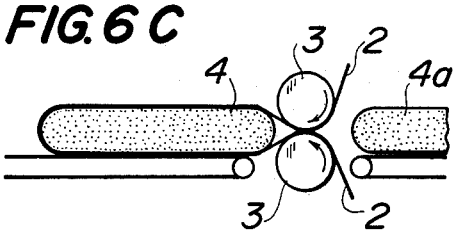
Figure 6B:
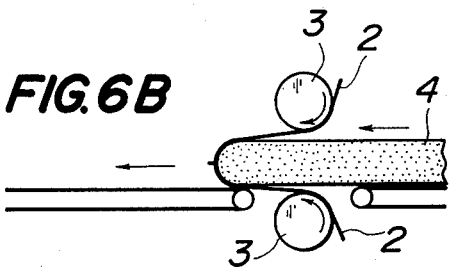
Figure 6A:
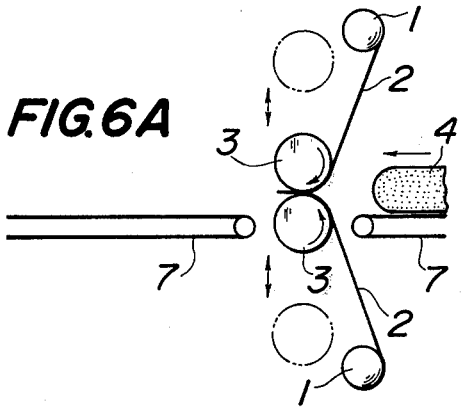

In this example, although the article has a square cross-section, the end surfaces thereof are tightly covered by the shrunk film as shown at 2′ in FIG. 4. There was no wrinkle at these portions.

In this example, the difference in the wrapping speed and the pay out speed of the heat shrinkable film is made smaller than that of the embodiment shown in FIG. 1 thereby decreasing the tension of the film, because too large tension causes breakage of the film. Further, in the case of a square or rectangular article being packed, it is advantageous to apply a thin sheet of polyethylene before wrapping the heat shrinkable film and to fix the protruded side edges of the sheet to the side surface of the article. With this measure, the heat shrinkable film well adheres to the sheet of polyethylene and assures satisfactory packing.

Another method of wrapping a heat shrinkable film about a square article is shown in FIGS. 5A through 5D. In this case, two coils 1 of the heat shrinkable film are disposed on both sides of an article 4 conveyed by a conveyor 7 and heating rods 3 are positioned at the center of the conveyor 7. The rods 3 are movable in the lateral direction to permit passage of the article 4 therebetween.

The free ends of the heat shrinkable film 2 paid out from coils 1 are fused together and positioned between the heating rods 3. At this time, the article 4 is moved in the direction of arrow C by the conveyor 7. The films are heated by the heating rods 3 respectively and coated on the side surfaces of the article 4 starting from its fore apex 4′ and while the articles are advanced through positions shown in FIGS. 5B, 5C and 5D, the films cover the entire surface of the article. At the position shown in FIG. 5D, the films 2 reach, the rear apex of the article at which time the heating rods 3 are brought together to fuse together the films. Then, the films are severed to complete the packing operation and the apparatus is conditioned to wait for the next cycle of packing the next article **4*a*.** According to this modified embodiment, it is not necessary to rotate the article to be packed, and the method is suitable for continuous operation.

FIGS. 6A through 6D show still another embodiment of this invention which is suitable for the continuous packing of relatively small articles 4, each having a rectangular cross-section with round ends. Since the packing operation of this embodiment is similar to that shown in FIGS. 5A through 5D, corresponding portions are designated by the same reference numerals for the purpose of avoiding duplicate description. This embodiment is different from that shown in FIGS. 5A through 5D only in that the films 2 are continuously applied to the opposite surfaces of successive articles 4 and fused together in the gap between adjacent articles and severed as at 10 shown in FIG. 6D.

It should be understood that the heating member for the heat shrinkable film may take various shapes other than a round rod, for example a platen.

As described above, according to this invention, a heat shrinkable film is contacted against a heating member heated to a temperature sufficient to cause the film to heat shrink while it is moved under tension and then immediately applied to pack an article having a width smaller than the heat shrinkable film. Accordingly, it is possible to tightly pack not only the periphery but also the end surfaces of the article by one operation. Where articles having different width are to be packed, films having different width are prepared. Where a suitable tension is applied to the heat shrinkable film, the width thereof is reduced so that the types of the film to be prepared can be reached. Moreover, as it is not necessary to preshape the film into bags commensurate with the shape of the articles to be packed, the processes steps of packing can be reduced. Further, it is possible to reduce the heat up time of the heating member than that of the conventional oven, thereby saving the time and power.

What is claimed is:

1. A method of packing an article with a heat shrinkable film comprising the steps of moving the heat shrinkable film, contacting the film against a heating member heated to a predetermined temperature sufficient to cause the film to shrink, and then immediately wrapping under a predetermined tension the heated film about an article to be packed having a width smaller than that of the heat shrinkable film with the side edges of the film protruded beyond the opposite ends of said article, and causing said film to shrink, thus tightly packing the article not only on the peripheral surface but also on the end surface of the article by the heat shrunk film.

2. The method according to claim 1 where said heat shrinkable film is caused to periodically engage and disengage said heating member.

3. A method of packing an article with heat shrinkable films, each having a width larger than that of said article, comprising the steps of continuously moving said article, continuously advancing a pair of heat shrinkable films toward said article from the opposite sides thereof, contacting the films against a pair of heating rollers movable toward and away from each other and heated to a predetermined temperature sufficient to cause said films to shrink, moving said heating rollers firstly away from each other and then toward each other while said article is moving continuously thereby covering the periphery and the end surfaces of said article by the heated films with the side edges thereof protruded beyond the opposite sides of the article and fusing together said pair of heat shrinkable films by said heating rollers while simultaneously causing the films to shrink about said article, and severing said films at the fused portion.

4. The method according to claim 3 wherein said article has a square cross-sectional configuration, said article is moved in the direction of a pair of diagonal apices thereof and said pair of heat shrinkable films are fused together and severed at said diagonal apices.

5. The method according to claim 3 wherein said article has an elongated rectangular cross-sectional configuration with round ends, said article is moved in the direction along the longer sides of said article, and said pair of heat shrinkable films are fused together and severed at said round ends.

* * * * *